United States Patent [19]

Sing

[11] Patent Number: 4,815,458

[45] Date of Patent: Mar. 28, 1989

[54] PROTECTIVE BREATHING APPARATUS

[76] Inventor: Peter Sing, 43 Donny Brook Rd., Scarsdale, N.Y. 10583

[21] Appl. No.: 92,575

[22] Filed: Sep. 3, 1987

Related U.S. Application Data

[63] Continuation-in-part of Ser. No. 890,137, Jul. 28, 1986, abandoned.

[51] Int. Cl.[4] ..... A62B 7/10

[52] U.S. Cl. ..... 128/201.25; 128/201.28; 128/205.12

[58] Field of Search ..... 128/200.27, 200.28, 128/201.23, 201.25, 201.26, 202.23, 205.12, 205.25, 205.23, 206.17, 201.28, 201, 113, 139; 2/171.3

[56] References Cited

U.S. PATENT DOCUMENTS

| | | | |
|---|---|---|---|
| 2,332,662 | 10/1973 | Nathanson | 128/205.12 |
| 3,657,740 | 4/1972 | Galone | 128/205.28 |
| 3,736,927 | 6/1973 | Misagi | 128/201.25 |
| 3,911,914 | 10/1975 | Johanisson | 128/201.23 |
| 4,236,514 | 12/1980 | Moretti | 128/201.23 |
| 4,411,264 | 10/1983 | Jacobson | 128/201.23 |
| 4,436,995 | 2/1984 | Hilton | 128/205.12 |
| 4,478,216 | 10/1984 | Pukowski | 128/205.12 |
| 4,516,936 | 4/1985 | Garcia | 128/202.22 |

FOREIGN PATENT DOCUMENTS

| | | | |
|---|---|---|---|
| 2719943 | 11/1978 | Fed. Rep. of Germany | 128/139 |
| 983290 | 2/1951 | France | 128/201.23 |
| 1068073 | 2/1954 | France | 108/200.28 |
| 8300632 | 3/1983 | PCT Int'l Appl. | 128/201.28 |
| 0608527 | 5/1978 | U.S.S.R. | 128/200.28 |
| 2058577 | 9/1979 | United Kingdom | 128/201.25 |

*Primary Examiner*—Edward M. Coven
*Assistant Examiner*—K. M. Reichle
*Attorney, Agent, or Firm*—Nathaniel Altman

[57] ABSTRACT

Protective breathing apparatus comprises a power-driven air blower which draws contaminated ambient air through selectively appropriate filters and propels the resultant purified air in controlled flow through conduit means into a flexible transparent plastic breathing hood encompassing the wearer's head and releasably secured by a neck ban around the wearer's neck. The purified air introduced into the breathing hood is distributed and circulated through the hood's interior, the current of air holding the hood substantially out of contact with the wearer's head. After the purified air has been breathed and then exhaled, it is expelled through an exhaust port to the atmosphere. Optional provision is made for adjusting the temperature of incoming treated air for maximum user comfort, and for a plurality of breathing hoods to be supplied by a single purified air source.

10 Claims, 2 Drawing Sheets

FIG. 7
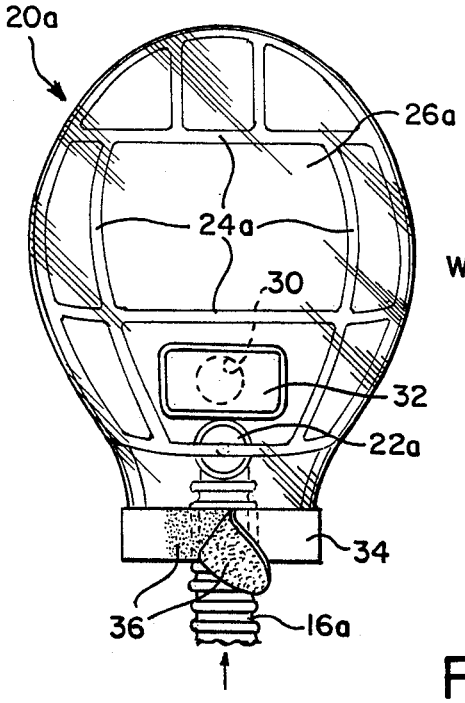
FIG. 8
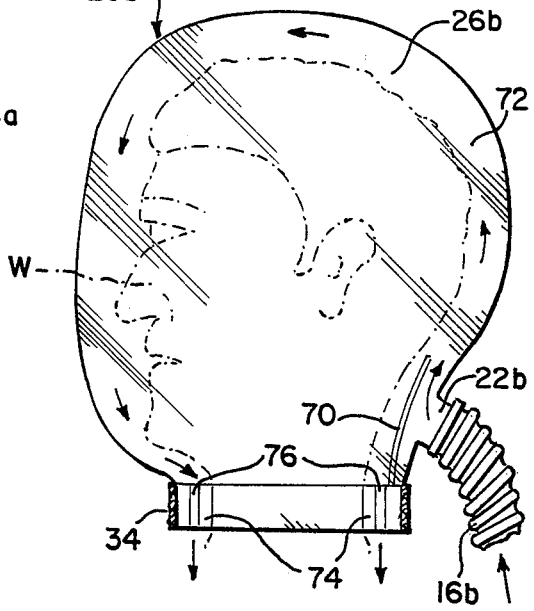
FIG. 9
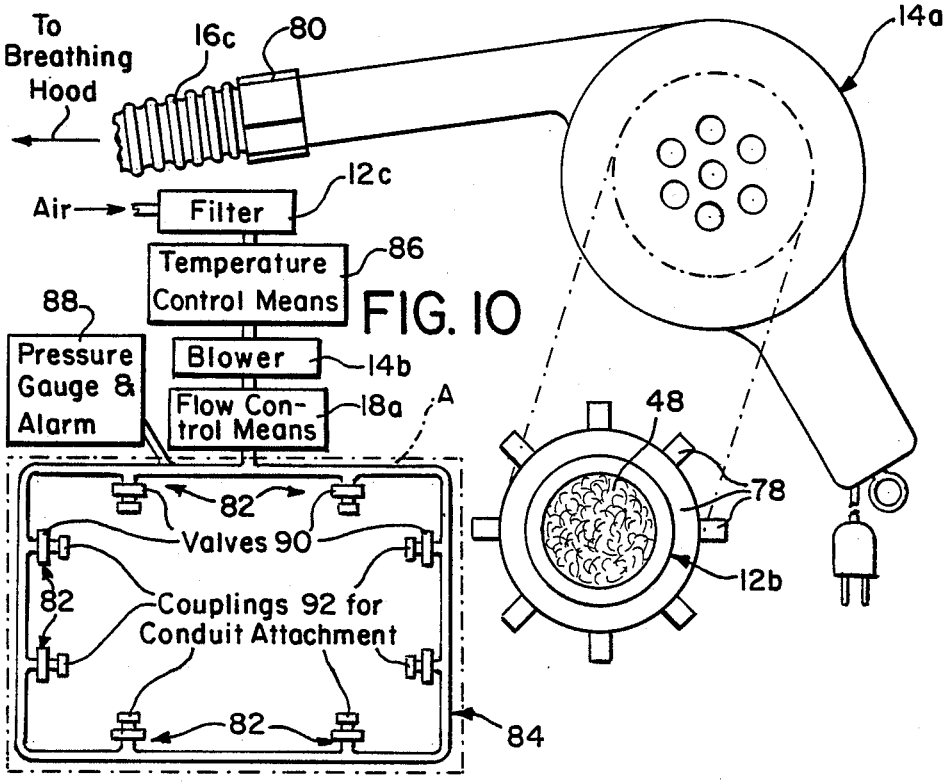
FIG. 10

PROTECTIVE BREATHING APPARATUS

BACKGROUND OF THE INVENTION

This is a Continuation-in-Part Application of application Ser. No. 06/890,137, filed on 07/28/86 now abandoned.

Numberless situations exist in which unpolluted wholesome air for breathing is not available without some means for removing the hazardous, irritating or otherwise objectionable contaminants from the local air supply. For example, in industrial areas and mines, noxious gases, poisonous fumes and irritating particulate matter are frequently encountered; in painting and cleaning operations, hazardous solvent vapors are at least part of the problem in the way of healthy breathing; while sanding and like procedures produce potentially dangerous dust.

The protective masks of the prior art now employed generally in these situations tend to be cumbersome and confining, with the pressure of their supporting bands precluding prolonged comfortable use. The same comments may be made for eye-protecting goggles, where their use in conjunction with breathing masks is required.

It is a primary object of this invention to provide an effective inexpensive apparatus for supplying purified healthful air for breathing, with protection and comfort for the eyes and face of the user at the same time. It is further an object of this invention to provide an apparatus easily portable and lightweight enough for prolonged wearing without discomfort. It is also an object of this invention to supply simultaneously the heads and faces of multiple users with air that has not only been freed of any deleterious gaseous, liquid or solid impurities but also adjusted in temperature for maximum user comfort. These and other objects will be explored in detail in the ensuing disclosure.

SUMMARY OF THE INVENTION

Ambient air is drawn into the intake of an air blower through a suitable filter medium which may be selected specifically for the removal of hazardous or objectionable impurities existing in the air of a given area. The resulting purified air is driven by the air blower in adjustably controlled flow through flexible conduit means into a flexible transparent plastic hood or helmet which covers the entire head of the user. The hood is fittingly held in place around the wearer's neck by adjustable and releasable fastening means. In some preferred embodiments, the treated air is passed through flexible distribution tubes which are positioned around, and attached to, the inner periphery of the hood; small openings in the distribution tubes permit the treated air to flow into the interior of the hood and become available for breathing. When in use, the hood's contact with the wearer's head is limited to the neck area and at a few points where the distribution tubes gently rest. A check-valved exhaust port is provided to allow used air to escape from the hood.

Another embodiment of the breathing hood eliminates the air distribution tubes, and the incoming treated air is directed by baffle around the wearer's head, resulting in a cushion of air which holds the hood's envelope out of contact with the head except at the neck, for maximum comfort. By use of multiple conduit means from a single air blower source, a plurality of breathing hoods may be supplied with wholesome air simultaneously. In addition, when conditions warrant the air supply may be warmed or cooled before use for the benefit and comfort of any and all users.

These and other concepts of this invention will now be described in full detail in connection with the accompanying illustrative drawings, wherein:

SHORT FIGURE DESCRIPTION OF DRAWINGS

FIG. 7 is a front elevational view of a second preferred embodiment of the protective breathing hood;

FIG. 8 is a right side elevational view of still another protective breathing hood embodiment;

FIG. 9 is an exploded right side elevational view of an alternate blower-filter combination; and FIG. 10 is a schematic plan view of a system for providing controlled cleansed air to a plurality of stations from which at least one user may supply his breathing hood.

DESCRIPTION OF THE PREFERRED EMBODIMENTS

Figure 1:
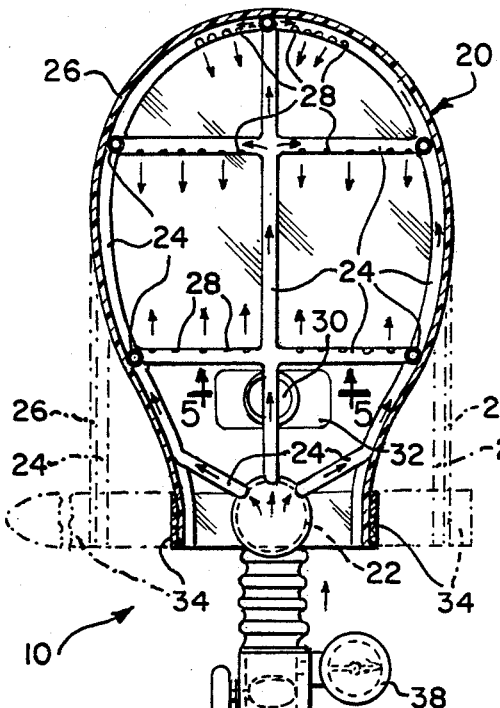
FIG. 1 is a rear elevational view of a preferred embodiment of this invention, with the breathing hood being shown in section taken along line 1—1 of FIG. 2.
Figure 2:
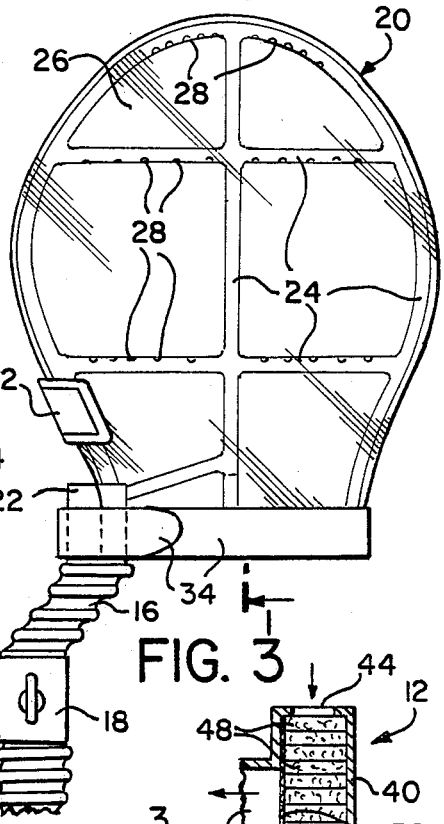
FIG. 2 is a right side elevational view of the hood of FIG. 1.

The protective breathing apparatus shown in FIGS. 1-3 and 5, generally designated 10, has filter element 12 mounted on the intake of power-driven air blower 14, which drives ambient air drawn through filter 12 into flexible conduit 16, through manually controlled flow control valve 18 and into the front of flexible transparent plastic hood or helmet 20 at its distributor head 22. Flexible intersecting distribution tubes 24, arranged and fixedly mounted on the inner surface of clear plastic hood envelope 26, carry the purified air to outlet openings 28 for diffused release of the air into the interior of hood 20. Exhaled used air is expelled through outlet exhaust port 30 and one-way valve 32. Strap 34, one end of which is fixedly attached to the base of hood 20 and provided with fastening means (e.g., the hook and loop type fastener 36, known as Velcro and illustrated in FIG. 7), serves to hold the hood assembly firmly but releasably over the head and around the neck of a wearer.

The dot-dash phantom position shown in FIG. 1 illustrates hood 20 in open position for placement on, or removal from, a user's head. It should be readily perceived that contact of hood 20 with wearer's head is limited to the neck and a few distribution tubes resting lightly, while the air current holds plastic hood envelope 26 away from the face and head, and, hence, long-lasting wearing comfort is achieved. Pressure gauge 38 may be inserted in conduit 16 at a location convenient for a user's observation, to ensure that air is being provided to hood 20.

Figure 3:
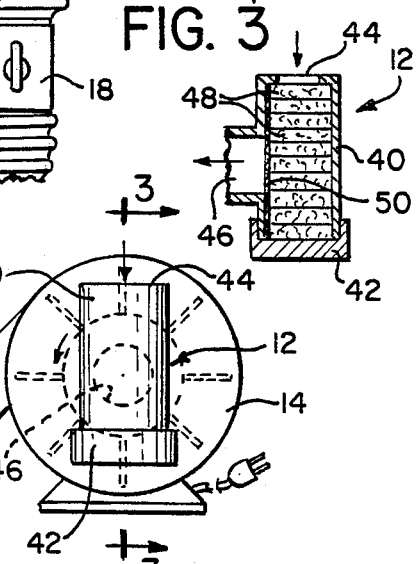
FIG. 3 is a sectional view taken along line 3—3 of FIG. 1 through the filter element.
Figure 4:
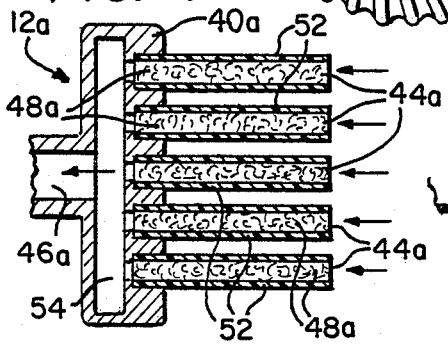
FIG. 4 is a sectional view similar to FIG. 3 showing another embodiment of a filter element.

Filter element 12, as best seen in FIG. 3, comprises housing 40, threaded base cap 42 attached thereto, inlet port 44 and outlet port 46, the latter leading into the intake of air blower 14. Ambient air drawn through filter 12 first encounters filter medium 48, the nature of which may vary widely to retain or neutralize whatever impurities exist in the air at any given location; examples of filter media of potential use for this purpose are: absorbents, adsorbents, chemically active agents, granules, fibrous matter, exchange resins, woven materials, activated charcoal, etc., or combinations thereof. A second filter 50 of finely woven fabric is here employed to ensure complete removal of particulate matter from the air passing through. An alternate filter element **12*a* is illustrated in FIG. 4, wherein housing 40*a* supports a plurality of thin plastic tubes 52 containing filter medium 48*a*, each tube 52 having an air entry port 44*a* through which the ambient air is drawn into plenum 54 before passing outlet port 46*a* into the intake of blower 14**.

Figure 6:
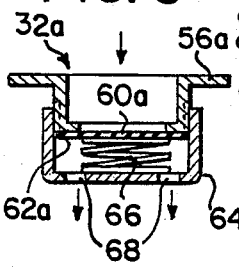
FIG. 6 is a sectional view similar to FIG. 5 showing another exhaust check valve embodiment.
Figure 5:
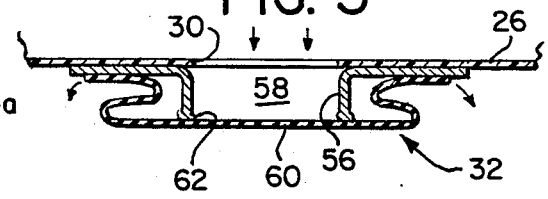
FIG. 5 is a sectional view taken along line 5—5 of FIG. 1 through the exhaust port check valve.

FIG. 5 shows the structure of hood 20's one-way exhaust valve 32, with valve housing 56 fixed to plastic hood envelope 26 at exhaust port 30. The pressure of exhaled air passing into valve chamber 58 intermittently lifts thin rubber diaphragm 60 from valve seat 62 and permits the used air to escape under the edges of the diaphragm. An alternate embodiment, exhaust valve **32*a*, is depicted in FIG. 6, wherein valve housing 56*a* has a threaded cap 64 which holds light coil spring 66 adjustably on diaphragm 60*a* against valve seat 62*a*. Exhaled air acts against spring 66 to lift diaphragm 60*a* and thus escapes through cap openings 68**.

A second preferred embodiment **20*a* of a breathing hood appears in FIG. 7; this version differs from hood 20 of the first embodiment described above in only two respects, (1) distributor head 22*a* and conduit 16*a* are positioned in the rear of hood 20*a* rather than in the front; and (2) flexible intersecting distribution tubes 24*a*, fixedly mounted on the inner surface of plastic hood envelope 26*a***, are arranged and positioned in a somewhat different pattern, as shown, to permit somewhat improved visibility through the transparent hood envelope.

Another breathing hood **20*b* of somewhat simplified construction is shown in FIG. 8. Here, flexible conduit 16*b* carries cleansed air to entrance port 22*b* of transparent hood envelope 26*b*. A baffle 70 mounted inside the rear of hood 20*b* directs the incoming air to circulate around the head of wearer W, and the air flow is sufficient to create air channel 72 between wearer W's head and hood envelope 26*b*, resulting in a breathing hood of maximum long-lasting wearer comfort. An inner collar 74, held in place around the wearer's neck by strap 34 has exhaust openings 76** which permit the passage of used air to the surrounding atmosphere.

A simple method of carrying out the concepts of this invention is illustrated by the structure of FIG. 9. Here, a conventional hair dryer may be used with or without heat as blower **14*a*, with simple filter element 12*b* to be fastened over hair dryer 14*a*'s intake by any convenient means, such as tape 78. The outlet end of blower 14*a* is operatively connected to conduit 16*c* by tape 80 to deliver filtered air to any one of the above-described breathing hoods 20, 20*a* or 20*b*. Blower 14*a* is obviously quite portable, allowing considerable mobility to the user of this apparatus FIG. 10 shows an example of how this invention may be applied to a relatively large area A where contaminated air exists, as, for example, a factory floor, a mine corridor or the like. As shown here, a plurality of air supply stations 82, positioned spacedly around the preiphery of rectangular area A, are fed with a clean air supply through air distribution piping network 84 from a source which includes ambient air drawn through filter 12*c* by air blower 14*b* and passed through flow control means or valve 18*a*; the source may also include means 86 for warming or cooling the air supply, if desired, and pressure indicator and alarm 88 may be connected at any convenient place in piping network 84 to warn against inadvertent failure of the system to provide adequate air for breathing. Each air supply station 82 has a valve 90 which serves dually as a shut-off or a one-way check valve, and each station 82 has a coupling 92 for operatively connecting a breathing hood (20, 20*a* or 20*b*) through its respective flexible conduit means (16, 16*a* or 16*b*). It is contemplated that stations 82** may be used by a plurality of hood-wearers at the same time, or, alternatively, by a single person shifting from station to station as his activities require.

The protective breathing apparatus of this invention has been descibed, One further concept remains to be disclosed; the use of its comfortable breathing hoods supplied with air enriched with oxygen for those in or out of hospitals whose breathing requires enriched air.

This disclosure is intended to be illustrative and not inclusive; various substitutions and combinations of elements lie within the scope of its concepts and structures, which are defined and limited only by the ensuing claims.

What is claimed is:

1. Protective breathing apparatus for providing air freed of hazardous or unpleasant contaminants to a user, in an area where the ambient air may be unsuitable for both safe breathing and eye comfort, which comprises:

selectively chosen filter media means for treating ambient air, said filter media means being capable of removing pollutants from air drawn therethrough;

a conventional portable blow dryer, comprising;

a housing having air inlet means operatively connected to said filter media means, said housing also having air outlet means; and air moving means mounted in said housing, said air moving means being capable of drawing ambient air through said filter media means and said air inlet means, and of blowing the filtered air through said air outlet means;

conduit means operatively connected to said air outlet means of said blow dryer, for carrying the filtered air propelled from said blow dryer;

a flexible transparent plastic breathing hood adapted to encompass the user's head, said breathing hood having an open lower end for allowing the introduction of the user's head therethrough into said breathing hood, said breathing hood being operatively connected to said conduit means, whereby said breathing hood is supplied with the filtered air propelled by said blow dryer through said conduit means;

releasable fastening means for closing and securing said open end of said plastic breathing hood around the user's neck;

means for distributing and circulating the filtered air drawn through said filter media means and propelled by said blow dryer through said conduit means into and throughout the interior of said breathing hood; and exhaust means for permitting breathed air to be released from said breathing hood.

2. Protective breathing apparatus in accordance with claim 1, wherein said means for distributing and circulating filtered air comprises a network of air distribution tubes operatively connected to said conduit means, said distribution tubes being positioned around and attached to the inner peripheral surface of said breathing hood, said distribution tubes having a plurality of small openings to permit diffused flow of filtered air carried from said blow dryer through said conduit means and said distribution tubes into said breathing hood.

3. Protective breathing apparatus in accordance with claim 1, wherein said means for distributing and circulating treated air comprises baffle means for directing the air flow supplied to said breathing hood from said conduit means around the head of the user, said baffle means being mounted in the portion of said breathing hood adapted to be positioned adjacent the back of the user's head so that the air entering said breathing hood from said conduit means operatively connected thereto is diverted from direct impingement on the user's neck by said baffle means and is caused to be diffused around the user's head and throughout said breathing hood.

4. Protective breathing apparatus in accordance with claim 1, further comprising flow control means, operatively connected at a point along the length of said conduit means, for regulating the flow of filtered air to said breathing hood.

5. Protective breathing apparatus in accordance with claim 4, further comprising an air pressure indicator operatively positioned in said conduit means between said flow control means and said breathing hood.

6. Protective breathing apparatus in accordance with claim 4, further comprising pressure-actuated alarm means operatively positioned in said conduit means between said flow control means and said breathing hood, said pressure-actuated alarm means being adjusted to alert the breathing apparatus user when insufficient air for breathing is being supplied to said breathing hood.

7. Protective breathing apparatus in accordance with claim 1, further comprising air temperature control means operatively positioned to regulate selectively the temperature of the filtered air passing through said conduit means to said breathing hood.

8. Protective breathing apparatus in accordance with claim 1, wherein said conduit means is a flexible air hose.

9. Protective breathing apparatus in accordance with claim 1, wherein said conduit means comprises:

a plurality of air outlet stations;

piping for carrying treated air from said blow dryer to said plurality of air outlet stations;

one-way valve means operatively positioned at each of said air outlet stations to permit the outward flow of air when actuated;

a flexible air hose for operatively connecting any of said air outlet stations to said flexible transparent plastic breathing hood; and coupling means positioned at each station for operatively joining said flexible air hose to any of said air outlet stations.

10. Protective breathing apparatus in accordance with claim 9, further comprising a plurality of said flexible transparent breathing hood, and a plurality of said flexible air hose, each of said breathing hoods being operatively connected to said coupling means of one of said plurality of air outlet stations through one of said plurality of air hoses whereby a plurality of hood-wearers may be provided simultaneously with treated air.

* * * * *